United States Patent [19]

Kaiser

[11] Patent Number: 4,481,032

[45] Date of Patent: Nov. 6, 1984

[54] PROCESS FOR ADDING CALCIUM TO A BATH OF MOLTEN FERROUS MATERIAL

[75] Inventor: Joseph G. Kaiser, Branford, Conn.

[73] Assignee: Pfizer Inc., New York, N.Y.

[21] Appl. No.: 522,754

[22] Filed: Aug. 12, 1983

[51] Int. Cl.[3] ..... C21C 7/02

[52] U.S. Cl. ..... 75/58; 75/53

[58] Field of Search ..... 75/53, 58

[56] References Cited

U.S. PATENT DOCUMENTS

| | | | |
|---|---|---|---|
| 2,577,837 | 12/1951 | Zifferer | 75/129 |
| 3,137,753 | 6/1964 | Feichtinger | 266/34 |
| 3,545,960 | 12/1970 | McClellan et al. | 75/51 |
| 3,715,202 | 2/1973 | Kosmider et al. | 75/58 |
| 3,728,109 | 4/1973 | Okubo et al. | 75/51 |
| 3,729,309 | 4/1973 | Kawawa | 75/53 |
| 3,760,862 | 9/1973 | Van Goudoever et al. | 164/55 |
| 3,768,999 | 10/1973 | Ohkubo et al. | 75/58 |
| 3,871,870 | 3/1975 | Nemoto et al. | 75/58 |
| 3,886,992 | 6/1975 | Maas et al. | 164/56 |
| 3,907,548 | 9/1975 | Steinmetz et al. | 75/51 |
| 3,954,134 | 5/1976 | Maas et al. | 164/266 |
| 4,094,666 | 6/1978 | Ototani | 75/53 |
| 4,143,211 | 3/1979 | Obinata | 75/53 |
| 4,154,604 | 5/1979 | Gruner | 75/53 |
| 4,200,456 | 4/1980 | Fujii | 75/93 G |
| 4,297,133 | 10/1981 | Fujii | 75/53 |
| 4,308,056 | 12/1981 | Guarino | 75/58 |

OTHER PUBLICATIONS

Sahai, Y. et al.; "Hydrodynamics of Gas Stirred Melts: Part 1. Gas/Liquid Coupling"; *Metallurgical Trans.;* 13B; pp. 193–202 (Jun. 1982).

Sahai, Y. et al.; "Hydrodynamics of Gas Stirred Melts: Part 2. Axisymmetric Flows"; *Metallurgical Trans.;* 13B; pp. 203–211 (Jun. 1982).

*Primary Examiner*—Peter D. Rosenberg

*Attorney, Agent, or Firm*—Charles J. Knuth; Peter C. Richardson; Lawrence C. Akers

[57] ABSTRACT

A process for adding calcium to a bath of molten ferrous material is disclosed in which a calcium metal-containing wire is fed through a refractory lance into the bath. Recirculatory stirring of the molten ferrous material is accomplished with an inert gas flow through the lance. The calcium-containing wire is fed at such a rate that it substantially bends towards the horizontal direction after it leaves the lance and melting of the calcium in the wire occurs primarily in or directly below a region of downwelling of the molten ferrous material. Suitable wire feeding rates will depend upon the disposition of the lance in the bath and the composition (e.g. clad or unclad) and cross-sectional dimensions of the calcium metal-containing wire.

9 Claims, 3 Drawing Figures

PROCESS FOR ADDING CALCIUM TO A BATH OF MOLTEN FERROUS MATERIAL

BACKGROUND OF THE INVENTION

In the production of steel, a ferrous melt is typically produced in a suitable furnace and then tapped into a ladle where it is treated with one or more ingredients for refining or alloying purposes. Thus, it is well known to add calcium to the molten ferrous material at this point as a refining agent for oxide inclusion flotation, oxide inclusion morphology modification, desulfurization, etc. Unfortunately, the low density (relative to steel), volatility and reactivity of calcium severely complicate the task of providing a satisfactory process for its addition to the molten material in the ladle.

A variety of techniques have been employed for the addition of calcium to the molten material in a steelmaking ladle. Bulk addition of calcium-containing particulate materials is unsatisfactory because these materials rapidly rise to the surface of the melt without spending a sufficient residence time therein. Efforts to increase residence time by pouring the particulate material directly into the tapping stream from the furnace give rise to excessive reaction of the calcium with atmospheric oxygen. Introductions of calcium-containing materials by plunging or the injection of clad projectiles into the melt generally provide adequate residence times but are complicated, expensive and time-consuming procedures. It has also been proposed to inject calcium-containing powders into a melt by inert gas injection through a refractory lance. Since sizable flows of gas are required to propel the powder into the molten ferrous material, a high level of turbulence is generated at the surface of the melt as the gas is released, thereby causing an excessive exposure of the molten ferrous material to oxygen and nitrogen in the atmosphere. Furthermore, after leaving the lance, the calcium tends to rise rapidly through the melt in the inert gas plume surrounding the lance or in upwelling molten material adjacent the plume. Thus, calcium residence time in the bath is unacceptably low.

In an attempt to overcome the above-mentioned problems, calcium has also been added to melts in steelmaking ladles in the form of a calcium metal-containing wire (clad or unclad) continuously fed through the upper surface of the melt. A major advantage of wire feeding is that large flows of gas are not needed, as in powder injection, to propel the calcium-containing material into the molten ferrous material. However, the high volatility of calcium hinders the attainment of an efficient utilization of the calcium added in surface wire feeding. If the wire does not penetrate to a sufficient depth below the surface before the calcium in the wire desolidifies, a low residence time and poor utilization of the calcium results along with a non-uniform treatment of the melt. It is particularly important that most or all of the input calcium remain unreacted until it descends below the depth at which the ferrostatic pressure is equal to the vapor pressure of calcium. This goal is difficult to achieve, even when a clad calcium metal-containing wire is employed. When calcium desolidifies at ferrostatic pressures lower than its vapor pressure, large calcium gas bubbles are formed that rise rapidly to the surface of the melt. The result is an inefficient, non-uniform treatment of the molten ferrous material and the generation of a large amount of turbulence at the surface of the melt.

U.S. Pat. No. 4,154,604 discloses a method and apparatus for adding a wire to molten metal in a vessel through a refractory clad tube filled with pressurized inert gas. This patent does not, however, disclose the desirability of effecting the melting of wire constituents at a substantial distance from the lower tip of the refractory clad tube in or directly below a region of downwelling of the molten metal. In fact, such a result is physically precluded in the preferred embodiment disclosed in said patent by the close proximity of the lower tip of the tube to the bottom wall of the vessel.

SUMMARY OF THE INVENTION

A novel process for adding calcium to a bath of molten ferrous material has now been discovered, which process comprises feeding a calcium metal-containing wire having a lower density than said ferrous material downwardly through a refractory lance inserted into said bath while providing a sufficient flow of inert gas through said lance to maintain the interior of the lance essentially free of said molten ferrous material and to induce substantial recirculatory stirring of said molten material, with the disposition of the lance in said bath and the composition, cross-sectional dimensions and feeding rate of said wire being such that (a) said wire bends substantially towards the horizontal direction after exiting from the wire outlet of the lance and before fully decomposing, and (b) at least a major part of the desolidification of the calcium in said wire occurs by melting in or directly below a region of downwelling of said molten ferrous material at a depth below the surface of said bath at which the ferrostatic pressure is greater than the vapor pressure of calcium at the temperature of said molten ferrous material. It is of course the buoyancy of the wire, resulting from its lower density than that of the melt, that causes it to bend. Preferably, while the wire is being fed through the lance, the wire outlet of the lance is positioned at a depth below the surface of said bath at which the ferrostatic pressure is greater than the vapor pressure of calcium at the melt temperature.

The desolidification of calcium at a ferrostatic pressure greater than its vapor pressure leads to the creation by melting of liquid calcium globules, which rise much more slowly through the melt (thus providing a much higher residence time) than do calcium gas bubbles. As these liquid globules slowly rise through the molten ferrous material in the bath, they eventually are transformed into a very large number of small gas bubbles that do not generate excessive turbulence when they reach the surface of the melt. Furthermore, according to the present invention, these liquid calcium globules rise through a region of downwelling in the circulatory motion of the melt in the bath. This countercurrent flow of the rising calcium and circulating molten ferrous phases greatly enhances the degree of contact between the calcium and the molten ferrous material and further increases the calcium residence time in the bath. As a result, the efficiency of utilization of the calcium refining additive is substantially improved.

Another advantage of the process of the present invention is that the inert gas flow rate in the lance can be varied independently of the wire feeding rate to optimize the internal melt circulatory stirring rate and the extent of slag/metal contact at the surface of the bath.

DETAILED DESCRIPTION OF THE INVENTION

The invention will be described in detail with reference to various preferred embodiments thereof. Reference to these embodiments does not limit the scope of the invention, which is limited only by the scope of the claims. In the drawings:

Figure 1:
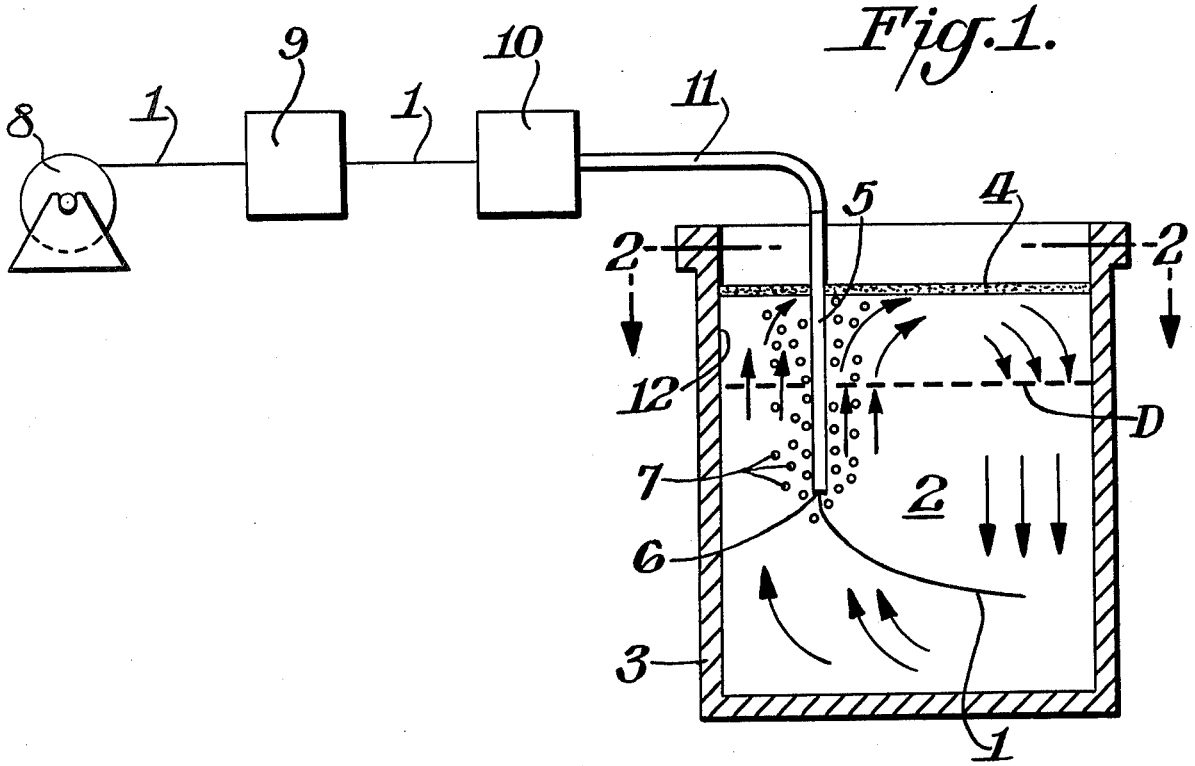
FIG. 1 is a schematic depiction of an apparatus suitable for use in the process of the present invention.
Figure 2:
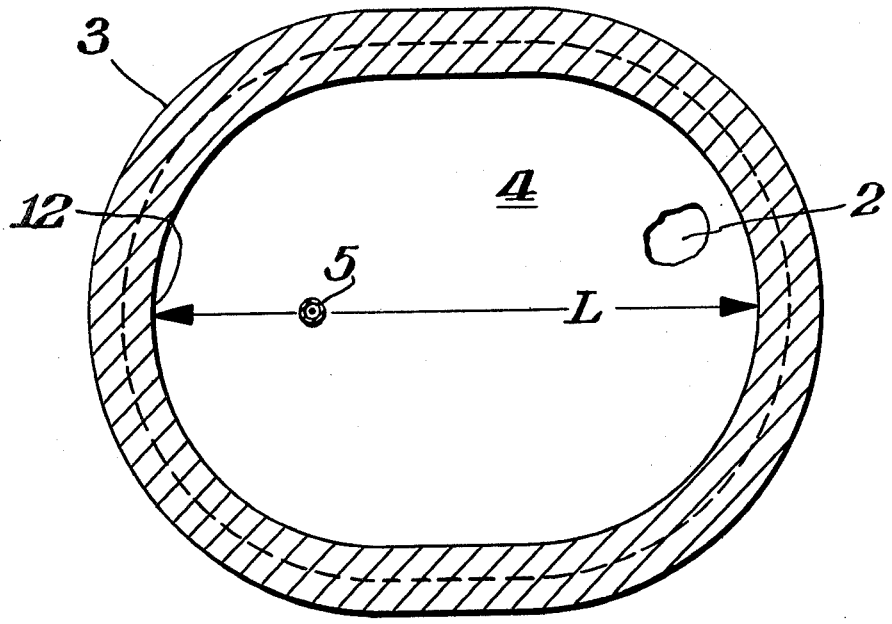
FIG. 2 is a view taken along line 2—2 in FIG. 1 showing the eccentric disposition of the refractory lance in the ladle.

A suitable apparatus for use in feeding a calcium metal-containing wire 1 into a bath 2 of molten ferrous material, e.g. steel, contained in a ladle 3 (which is open to the atmosphere) is shown in FIGS. 1 and 2. In the present invention, wire 1 has a lower density than the molten ferrous material 2. As used herein, the term "calcium metal-containing wire" means that such a wire is comprised at least in part of unalloyed elemental metallic calcium as a distinct phase. The wire may also contain distinct phases of calcium alloys (e.g. a calcium-aluminum alloy) or calcium compounds (e.g. calcium silicide) or other ingredients being added to the molten ferrous material for refining or alloying purposes (e.g., aluminum, magnesium, rare earth elements). The calcium metal-containing wire may be clad (e.g. with a steel cladding) or unclad. In the former case, the calcium metal-containing core of the clad wire may itself be a wire or may exist in any other known form, e.g. a powder. Preferably, a surface layer 4 of a basic synthetic slag containing e.g. lime and fluorspar is applied to the melt 2 prior to commencement of the wire feeding. As used herein, the terms "depth below the surface of the bath", "depth below the surface of melt 2", etc., refer to the depth below the slag/molten metal interface.

As is best shown in FIG. 1, wire 1 is fed into melt 2 downwardly through a refractory lance 5 inserted into the bath 2 of molten ferrous material. Simultaneously, a flow of gas inert to the molten ferrous material (e.g. argon) is provided through the lance. This inert gas exits from the wire outlet 6 of lance 5 and rises as a multiplicity of bubbles 7 surrounding lance 5 to the surface of the melt. The pressure and flow rate of the inert gas must be sufficient to maintain the inner bore of the lance free of molten ferrous material and thus prevent blockage of the bore by solidification of said material. Moreover, the inert gas pressure and flow rate should be sufficient to induce a substantial recirculatory stirring of the melt 2 in ladle 3 (note arrows in bath 2 in FIG. 1). Preferably, however, the inert gas flow rate is not so high as to generate a large amount of turbulence on the surface of the melt as the bubbles 7 escape to the atmosphere. A preferred range for the flow rate of inert gas through lance 5 is from about $1.5\times10^{-5}$ to about $4\times10^{-5}$ standard ft.$^3$/(min. lb. of melt). Since the inert gas in lance 5 is not relied upon to propel the wire 1 into the melt, its flow rate through the lance can be adjusted independently of the wire feeding rate. The inert gas pressure in lance 5 must, of course, be greater than the ferrostatic pressure at the wire outlet.

As used herein, the term "refractory lance" means that at least those outermost longitudinal portions of lance 5 that come into contact with the molten ferrous material 2 are made of a refractory material (e.g. alumina) that is resistant to physical or chemical change while subjected to such contact. Preferably, lance 5 is straight and oriented in a vertical manner while wire 1 is being fed through it. However, lance 5 may also be tilted away from a vertical orientation during the wire feeding (but not horizontal). Also, the lance may have a "dog-legged" shape. The lance is provided with a wire inlet and a wire outlet, with the wire inlet at a higher elevation during use than the wire outlet. Usually, the wire outlet is at the lower tip of the lance. However, it is possible, e.g., to employ a lance having a side port wire outlet displaced from the lower tip of the lance.

In addition to lance 5, the apparatus shown in FIG. 1 includes a wire spool 8, a mechanical wire feeder 9, an inert gas feeding and sealing assembly 10 and a gas-tight wire conduit 11 connecting assembly 10 to and supporting lance 5. Although not essential to the practice of the present invention, it is preferred to employ a mechanical wire feeder 9, an inert gas feeding and sealing assembly 10 and a refractory lance 5 of the types disclosed in the concurrently filed, copending, commonly assigned U.S. patent application of Emil J. Wirth, Jr. entitled "Wire Injection Apparatus", Ser. No. 522,753, filed Aug. 12, 1983. If wire 1 includes exposed elemental calcium metal at its outer surface, such as when it is an unclad calcium metal wire, conventional steps will have to be taken to protect the wire on spool 8 from atmospheric attack, such as maintaining spool 8 in a housing pressurized with calcium-inert gas.

Figure 3:
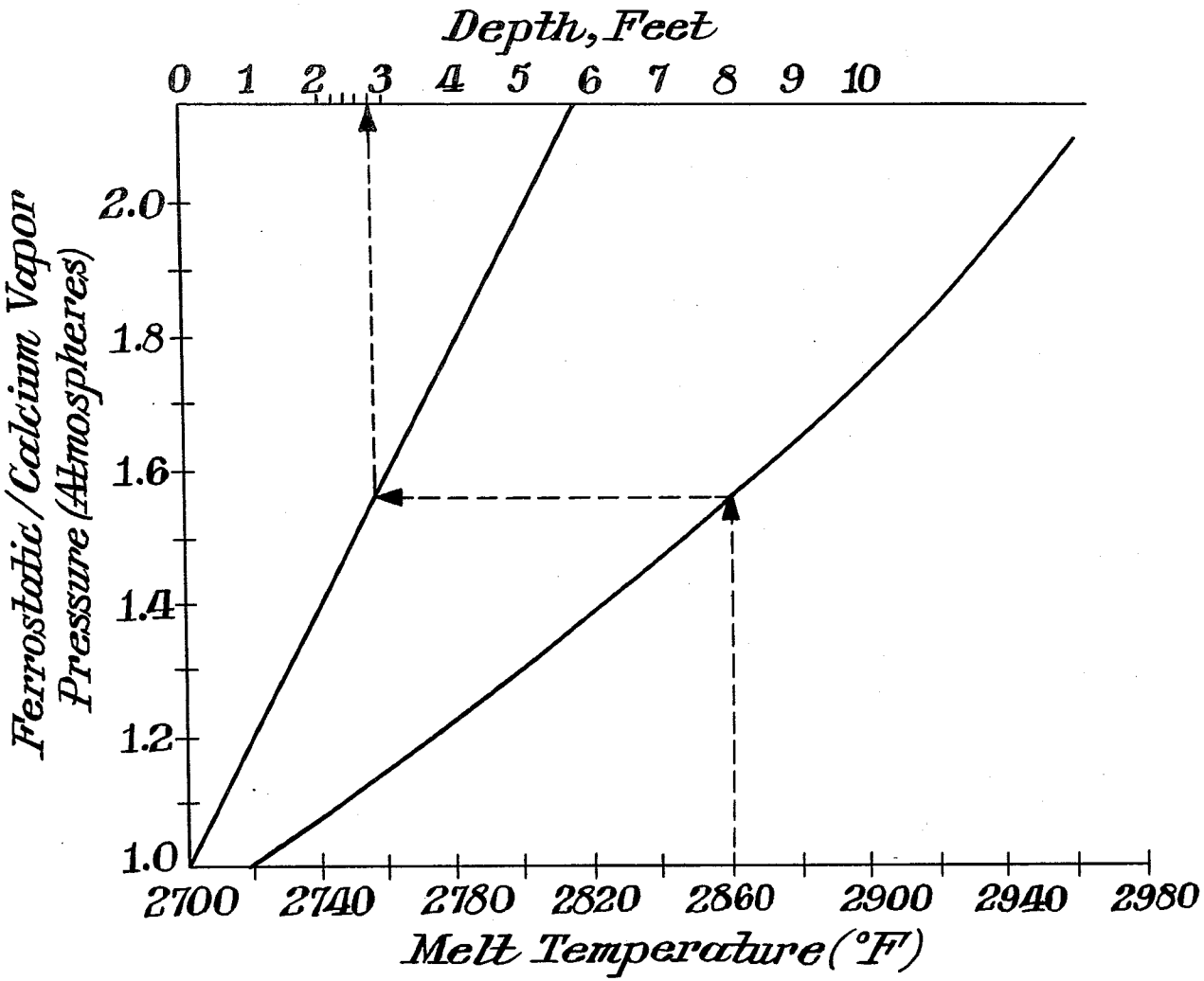
FIG. 3 is a chart that can be used to determine the critical depth of molten steel in a ladle, i.e. the depth below the surface of the molten steel at which the ferrostatic pressure equals the vapor pressure of calcium, as a function of temperature.

In typical steelmaking operations, the temperature of the molten ferrous material 2 in ladle 3 ranges from about 2800° F. to about 3000° F. At these temperatures the vapor pressure of calcium is quite substantial. As discussed earlier, it is essential to the full success of the calcium addition operation that a major part (or all) of the desolidification of the elemental calcium metal in wire 1 occur by melting rather than by vaporization. Thus, this desolidification must occur below the critical depth in the melt, which is defined as that depth below the surface of the melt at which the ferrostatic pressure is equal to the vapor pressure of calcium (at the melt temperature). The critical depth may be readily determined as a function of temperature by using the chart provided in FIG. 3. The rightmost curve in FIG. 3 is a plot of calcium vapor pressure vs. temperature, while the leftmost curve is a plot of ferrostatic pressure vs. depth below the surface of the melt. At 2860° F., for example, the vapor pressure of calcium is 1.57 atm. A ferrostatic pressure of 1.57 atm. is experienced at a depth of 2.8 feet, which is thus the critical depth at 2860° F.

At the heart of the present invention is the concept of adjusting the disposition of lance 5 in melt 2 and the composition, cross-sectional dimensions and feeding rate of wire 1 so that (a) the wire bends substantially towards the horizontal direction after exiting from the wire outlet of the lance and before fully decomposing, and (b) at least a major part of the desolidification of the calcium in the wire occurs by melting in or directly below a region of downwelling of the molten ferrous material at a depth below the critical depth D (see FIG. 1).

As used herein, the term "disposition of the lance" or "lance disposition" contemplates both the depth of the lance in the bath and its position in horizontal planes through the bath (e.g. the plane of FIG. 2), as well as the orientation of the lance with respect to the vertical (i.e. the degree and direction of its tilt, if any, away from the vertical). The four variables of lance disposition, wire composition, wire cross-sectional dimensions and wire feeding rate are interrelated, so that a change in one of said variables may require that one or more of the remaining variables be readjusted to continue obtaining the results (a) and (b) set forth above. Thus, for example, it is preferred that the lance be disposed so that its wire outlet 6 is positioned below the critical depth while the wire is being fed through the lance, as shown in FIG. 1. However, it is also possible to operate with the wire outlet of the lance somewhat above the critical depth. In this case, it may be necessary to increase the wire feeding rate, increase the wire diameter or switch to a clad wire in order to continue the practice of the present invention. It is also preferred that the lance 5 be non-centrally disposed in the ladle 3, as viewed in horizontal planes such as the plane of FIG. 2. This eccentric disposition of lance 5 in ladle 3 serves to increase the volume of the target downwelling region in the recirculating melt 2 by concentrating downwelling on one side of the ladle (see FIG. 1). Preferably, the distance between the longitudinal axis of lance 5 and the inner surface of the nearest ladle side wall (e.g. surface 12 in FIGS. 1 and 2) is from about 1/6 to about ⅓ of the longest linear dimension L of the bath, as viewed in horizontal planes. This longest linear dimension of the bath would be its major axis in the case of a ladle with elliptical or oval cross-section, its diameter in the case of a ladle with circular cross-section, its length in the case of a ladle with rectangular cross-section, etc.

Since the distance that a particular wire 1 will travel from the wire outlet 6 of lance 5 before fully decomposing will depend directly upon the wire feeding rate, this rate is a very important variable. In the practice of the present invention, decreasing the thickness of wire 1 or changing from a clad to unclad wire will tend towards requiring an increase in the wire feeding rate. Also, a higher melt temperature will tend to require a higher wire feeding rate. In the case in which wire 1 is an unclad calcium metal wire having a diameter of from about 8 mm. to about 12 mm., lance 5 is straight and vertically-oriented in the bath, the wire outlet 6 of lance 5 is at the lower tip of the lance and is positioned below the critical depth D, the distance between the longitudinal axis of the lance and the inner surface of the nearest ladle side wall is from about 1/6 to about ⅓ of the longest linear dimension of the bath (in horizontal planes), and the temperature of the molten ferrous material 2 is from about 2800° F. to about 3000° F., a preferred range for the wire feeding rate in the practice of the present invention is from about 500 ft./min. to about 1000 ft/min.

The following examples illustrate the invention but are not to be construed as limiting the same.

EXAMPLE 1

Clad Calcium Metal Wire 3600 lbs. basic slag mix was added to the bottom of a ladle having an elliptical cross-section in horizontal planes, and 210 tons of molten steel was then tapped from a furnace into the ladle. The sulfur content of the steel was reduced from 0.021 wt. % to 0.008 wt. % as a result of the tapping operation. An 8 ft. long straight refractory lance of the type described in the aforementioned concurrently filed patent application of Emil J. Wirth, Jr. was then disposed in the bath of molten steel, with the lance being vertically-oriented and positioned on the major axis of the elliptical ladle cross-section at a distance of about ⅓ of the length of said major axis from the inner surface of the nearest ladle side wall, and with its wire outlet at its lower tip being positioned 6 ft. below the surface of the molten steel bath. With pressurized (30 psi) argon flowing through the lance at 12 scfm, 3000 ft. of clad calcium metal wire (49 wt. calcium metal core—51 wt. % 0.010 in. thick 1010 steel cladding) having a total diameter of 8 mm. was then fed downwardly into the molten steel bath through the lance at a feed rate of 550 ft./min. The temperature of the molten steel in the ladle was 2860° F., which corresponds to a critical depth of 2.8 ft. After exiting from the lower tip of the lance, the wire bent substantially towards the horizontal direction. Complete decomposition of the wire occurred at a distance of about 10 feet from the lower tip of the lance. After completion of the wire feeding, the molten steel in the ladle was tapped and cast into appropriate molds. The cast steel product contained 0.22 wt. % carbon, 1.36 wt. % manganese, 0.03 wt. % aluminum, 0.12 wt. % vanadium, 0.005 wt. % sulfur and 45 ppm calcium. 100% inclusion modification was observed.

EXAMPLE 2

Unclad Calcium Metal Wire

The procedure of Example 1 may be repeated with the use of an unclad calcium metal wire. Operating equipment and conditions are substantially unchanged, except that an unclad 12 mm. diameter calcium metal wire is fed to the bath of molten steel for one minute at a rate of 800 ft./min. After exiting from the wire outlet at the lower tip of the lance, the wire bends substantially towards the horizontal direction. Complete decomposition of the wire occurs at a distance of about 10 feet from the lower tip of the lance.

I claim:

1. A process for adding calcium to a bath of molten ferrous material which comprises feeding a calcium metal-containing wire having a lower density than said ferrous material downwardly through a refractory lance inserted into said bath while providing a sufficient flow of inert gas through said lance to maintain the lance essentially free of said molten ferrous material and to induce substantial recirculatory stirring of said molten material, with the disposition of the lance in said bath and the composition, cross-sectional dimensions and feeding rate of said wire being such that (a) said wire bends substantially towards the horizontal direction after exiting from the wire outlet of said lance and before fully decomposing, and (b) at least a major part of the desolidification of the calcium in said wire occurs by melting in or directly below a region of downwelling of said molten ferrous material at a depth below the surface of said bath at which the ferrostatic pressure is greater than the vapor pressure of calcium at the temperature of said molten ferrous material.

2. A process of claim 1 wherein the wire outlet of said lance is positioned, while said wire is being fed through said lance, at a depth below the surface of said bath at which the ferrostatic pressure is greater than the vapor pressure of calcium at the temperature of said molten ferrous material.

3. A process of claim 2 wherein said lance is straight, said wire outlet is at the lower tip of the lance, and said lance is vertically-oriented while said wire is being fed through it.

4. A process of claim 2 wherein said lance is tilted away from a vertical orientation while said wire is being fed through it.

5. A process of claim 3 wherein said lance is eccentrically-disposed in said bath, as viewed in horizontal planes, while said wire is being fed through said lance.

6. A process of claim 2 wherein said bath has a temperature of from about 2800° F. to about 3000° F.

7. A process of claim 2 wherein said wire is an unclad wire containing exposed calcium metal at the outer surface thereof.

8. A process of claim 5 wherein said bath is held in a vessel having bottom and generally vertical side walls and the distance between the longitudinal axis of said lance and the inner surface of the vessel side wall nearest thereto is from about 1/6 to about $\frac{1}{3}$ of the longest linear dimension of said bath in horizontal cross-sectional planes.

9. A process of claim 8 wherein said bath has a temperature of from about 2800° F. to about 3000° F., said wire is an unclad calcium metal wire having a diameter of from about 8 mm. to about 12 mm., and said wire is fed through said lance into said bath at a feeding rate of from about 500 ft./min. to about 1000 ft./min. F/

* * * * *